US007455360B2

(12) United States Patent
White et al.

(10) Patent No.: US 7,455,360 B2
(45) Date of Patent: Nov. 25, 2008

(54) SEATING FURNITURE WITH LIFT MECHANISM

(75) Inventors: Nikki White, Pontotoc, MS (US); Shelby Ladner, New Albany, MS (US); Bill Tacker, Smithville, MS (US); Kenneth Graham, Tupelo, MS (US)

(73) Assignee: L & P Property Management, South Gate, CA (US)

( * ) Notice: Subject to any disclaimer, the term of this patent is extended or adjusted under 35 U.S.C. 154(b) by 0 days.

(21) Appl. No.: 11/548,434

(22) Filed: Oct. 11, 2006

(65) Prior Publication Data

US 2007/0246986 A1 Oct. 25, 2007

Related U.S. Application Data

(63) Continuation-in-part of application No. 11/379,665, filed on Apr. 21, 2006, now abandoned.

(51) Int. Cl.
*A47C 1/12* (2006.01)

(52) U.S. Cl. ..... 297/330; 297/321; 297/323; 297/344.14; 297/344.17

(58) Field of Classification Search ..... 297/321, 297/323, 344.14, 344.16, 344.17, 344.19, 297/330, DIG. 10
See application file for complete search history.

(56) References Cited

U.S. PATENT DOCUMENTS 3,138,402 A * 6/1964 Heyl, Jr. et al. ..... 297/69
4,249,774 A 2/1981 Andreasson
4,637,652 A 1/1987 Bergenwall
5,094,508 A 3/1992 Bathrick
5,423,594 A 6/1995 Hancock
5,803,545 A 9/1998 Guguin
5,806,920 A * 9/1998 Blount ..... 297/68
5,918,936 A 7/1999 Murphy
5,984,411 A * 11/1999 Galumbeck ..... 297/344.15
6,213,554 B1 4/2001 Marcoux
6,533,353 B2 3/2003 Johnston
6,557,940 B2 5/2003 Hayashi
6,578,918 B1 6/2003 Rinne
6,709,058 B1 3/2004 Diffrient
6,752,459 B2 6/2004 Deisig
6,783,179 B2 8/2004 Komura
6,871,910 B2 * 3/2005 Hale ..... 297/330
7,000,988 B2 2/2006 Bressler
7,021,713 B2 * 4/2006 Kao et al. ..... 397/339

* cited by examiner

*Primary Examiner*—Laurie K Cranmer
(74) *Attorney, Agent, or Firm*—Shook, Hardy & Bacon L.L.P.

(57) ABSTRACT

An article of seating furniture is provided with a lift mechanism. The article can be a chair with a base and a seat that is pivotally connected to the base. A back is coupled to the seat and may be either fixed to the seat or rotatably coupled to the seat. An actuator is mounted to the base extending towards the rear of the chair. The actuator is pivotally coupled to the base on one end and is pivotally coupled to the seat on the other end. The actuator moves the seat between a generally horizontal position and a raised position. With the back rotatably mounted to the seat, a linkage bar can be added that extends from base front to a bracket that mounts the back to the seat. The linkage bar reclines the back as the seat is raised from horizontal position to the raised position.

2 Claims, 19 Drawing Sheets

SEATING FURNITURE WITH LIFT MECHANISM

CROSS-REFERENCE TO RELATED APPLICATIONS

This application is a continuation-in-part of prior application number Ser. No. 11/379,665 filed on Apr. 21, 2006.

STATEMENT REGARDING FEDERALLY SPONSORED RESEARCH OR DEVELOPMENT

Not applicable.

BACKGROUND

Lift chairs are now well known in the art. These lift chairs extend beyond chairs to all types of seating furniture, including sofas, chairs and sectionals. A lift chair is designed to assist a user both in sitting down in a chair and in getting up from a chair. A wide variety of lift chairs now exist in the marketplace. All of these lift chairs achieve the basic function of raising some portion of the chair to assist the user. Some chairs raise just the arms, while others raise the seat, back and arms together in one unit. People need and use lift chairs for a variety of reasons, most of which relate to the health and strength of the user.

While lift chairs currently exist, they suffer certain drawbacks. Most lift chairs utilize relatively complex lifting mechanisms. This complexity leads to increased weight, cost and repair concerns. A relatively simple lift chair mechanism is needed. Additionally, lift chair mechanisms offer limited, if any, flexibility to the manufacturers. If a lift mechanism is used, the chair manufacturer may not have the flexibility needed to configure the lift chair as desired. In some instances, it may be desirable to lift the seat and back together in one unit, maintaining the orientation of the back relative to the seat. In other instances, it may be desirable to position the back more vertically as the seat is lifted. A lift mechanism that offers manufacturers and users the flexibility to configure a lift chair for both instances is needed. Lift chairs also exist that offer a reclining back feature in addition to the lift feature. However, these mechanisms suffer from the complexity concern noted above. A lift mechanism offering a reclining back feature is needed that is simple in construction.

Thus, while lift chairs are known, there remains a need for a lift chair and lift chair mechanism that are of relatively simple construction, that offer flexibility in configuration and that can accommodate a reclining back feature, while not limiting the furniture styling.

BRIEF SUMMARY OF THE INVENTION

Accordingly, the present invention provides an article of seating furniture with a lift mechanism. The article of seating furniture can be a chair with a base and a seat that is pivotally connected to the base. A back is coupled to the seat and may be fixed with respect to the seat in one embodiment and rotatably coupled to the seat in another embodiment. An actuator is mounted to the base, preferably in the middle of the base and extending towards the rear of the chair. The actuator is pivotally coupled to the base on one end and is pivotally coupled to the seat on the other end. In use, the actuator is used to move the seat from a generally horizontal position of normal use, to a raised assisted position that allows the user to more easily exit the chair. In the embodiment where the back is rotatably mounted to the seat, a linkage bar can be added that extends from the front of the base to a lower portion of the bracket that mounts the back to the seat. The linkage bar functions to recline the back as the seat of the chair is raised from the seated position to the assisted position.

In yet another embodiment a second actuator can be mounted below the connection point of the first actuator to the seat. This second actuator is coupled on the other end to the back brackets. The second actuator can be used to selectively recline the back from an upright position to a reclined position.

In yet another embodiment, a four bar linkage is used to couple the seat to the base. In this embodiment, the seat is not directly pivotally coupled to the base at a single point. Instead, the four bar linkage is used to control the motion of the seat as the actuator of the seat is engaged. The four bar linkage raises the rear of the seat relative to the front of the seat, but also raises the front of the seat relative to the base of the chair.

As will be seen from the detailed description that follows, the lift mechanism utilizes fewer working parts than the previous embodiments contained in the prior art. Additional advantages, and novel features of the invention, will be set forth in part in a description which follows and will become apparent to those skilled in the art upon examination of the following, or may be learned by practice of the invention.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION

Figure 1:
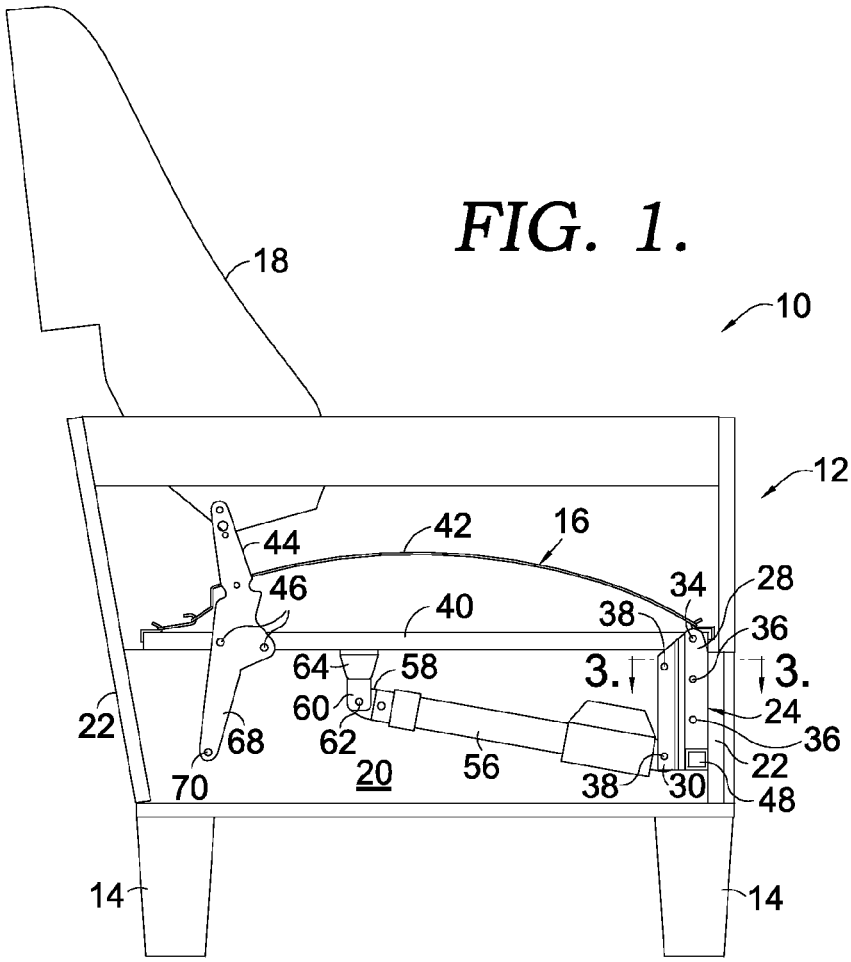
FIG. 1 is a side cross-sectional view of an article of seating furniture with certain parts removed for clarity.
Figure 3:
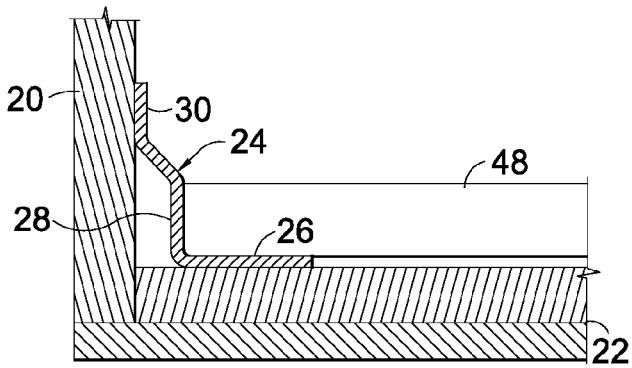
FIG. 3 is a partial, enlarged, cross-sectional view taken along the line 3-3 of FIG. 1.
Figure 2:
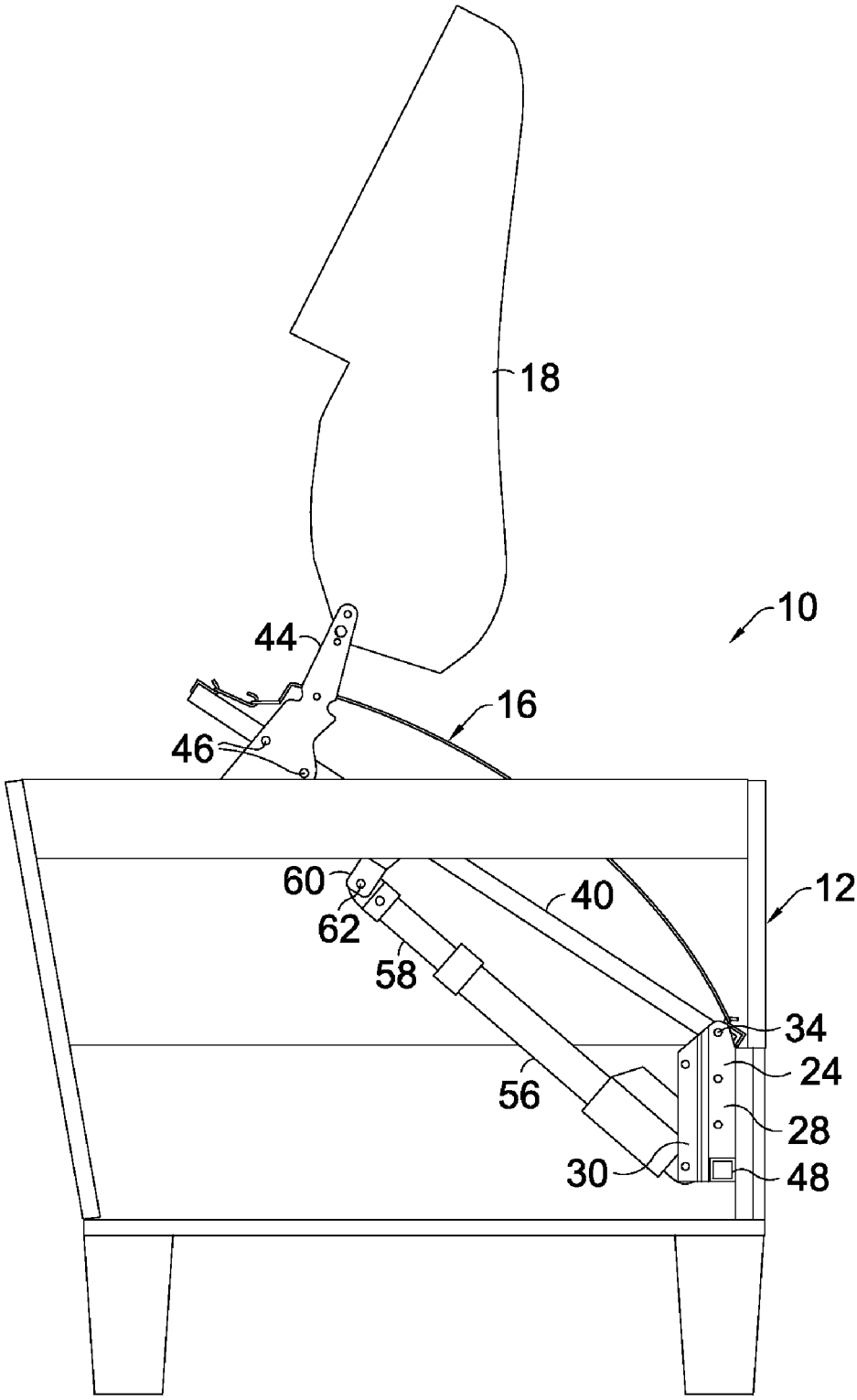
FIG. 2 is a view similar to FIG. 1, showing the seat in a raised position.

Referring to the drawings in greater detail and initially to FIG. 1, a lift chair 10 is shown and designated generally by the numeral 10. Chair 10 includes a base 12, a number of legs 14, a seat 16 and a back 18. Chair 10 is shown with certain parts removed, such as the seat fabric, cushioning, etc, for the sake of clarity in the explanation that follows. It should be understood that chair 10, in use, is a fully-finished chair. The base 12 typically sits on the legs 14 providing the appearance of an ordinary chair. Base 12 includes left and right side panels 20 and front and back panels 22. Panels 20 and 22 form a frame for attachment of the seat, arms and other components of the finished chair. As best seen in FIG. 3, front frame panel 22 can be a two-piece construction, as shown, but could also be a one-piece construction.

Figure 4:
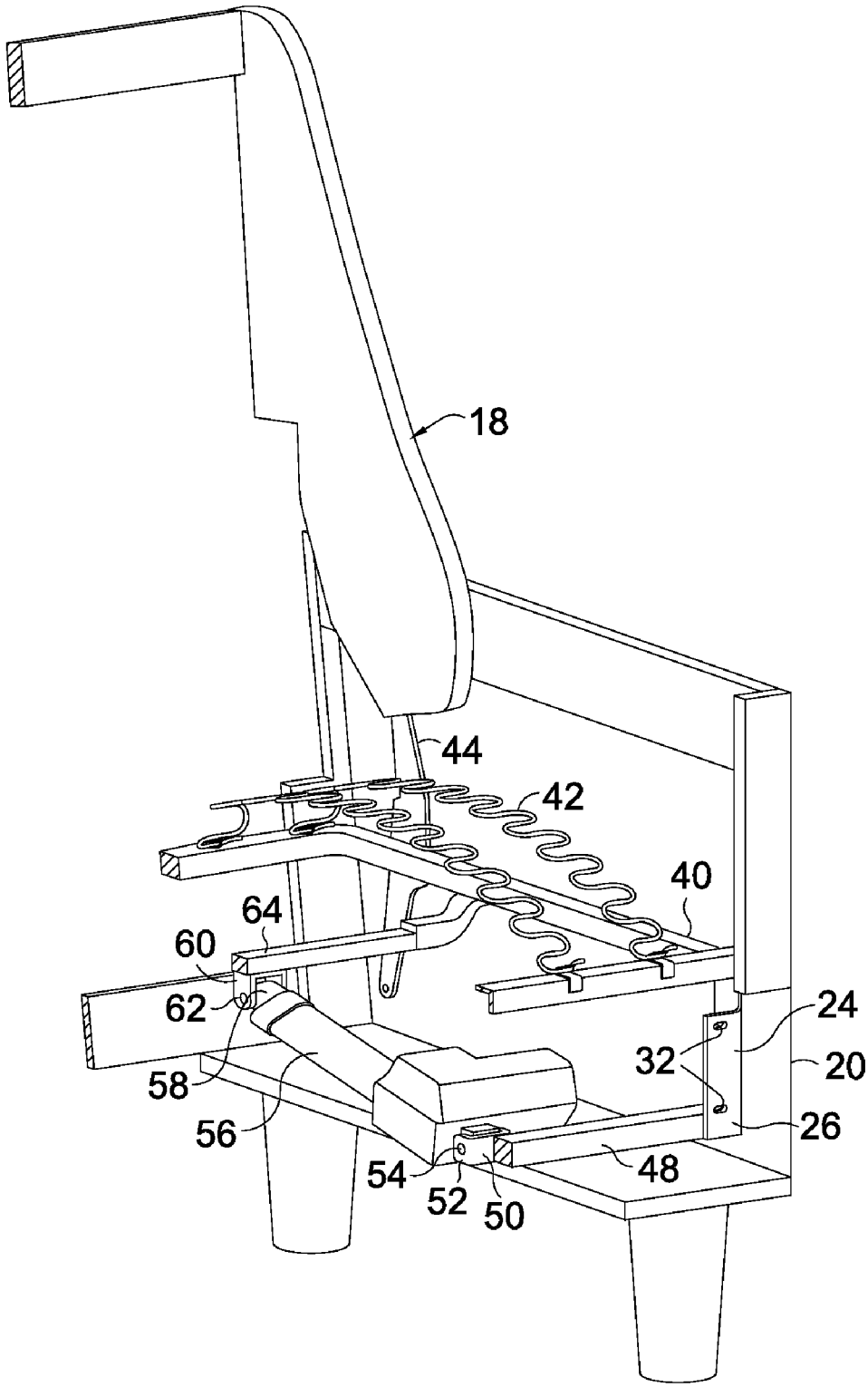
FIG. 4 is a partial perspective cross-sectional view of the article of FIG. 1.

As best seen in FIGS. 1-4, a lift frame bracket 24 is attached to the front panel 22. Frame bracket 24 has a front section 26 and a side section 28 that transitions to a back section 30. The front section 26 has a pair of mounting holes 32 (as seen in FIG. 4) that are used to couple the bracket 24 to the front panel 22. For example, bolts or screws could be used to connect these two elements. Other mounting mechanisms could also be used. The side section 28 also has a number of holes. The upper-most hole 34 is used to couple the bracket 24 and the seat 16, as is further described below. The lower-most holes 36 are used to couple an articulating link to the back 18, as will be described below with reference to FIGS. 5-7. The back section 30 also has a pair of mounting holes 38 that are used to couple bracket 24 to side panels 20. Again, bolts, screws or other mounting mechanisms could be used to achieve this end.

Seat 16 is supported on chair 10 with a seat frame 40. Seat frame 40 is preferably made from a sturdy material, such as square steel tubing. It should be understood that other materials with similar characteristics could be used as well. Seat frame 40 is shaped with a perimeter matching that of seat 16. The front portion of seat frame 40 is pivotally coupled to base 12. More specifically, the front portion of seat frame 40 is pivotally coupled to side section 28 of bracket 24 using the upper-most hole 34. This can be achieved with a pin, rivet, or other attaching mechanism that couples the seat frame 40 to the bracket 24 in a manner that allows the seat frame to pivot with respect to the base 12. As best seen in FIG. 4, a seat suspension system is typically provided, such as through the use of sinuous wire springs 42. The use of springs 42 is well known in the art, as are other suspension methods. The particular manner of support is not of particular importance, and any of the known methods are acceptable. In use, additional padding and covering material would be used, as is clearly understood by those in the art.

Returning to FIG. 1, a back bracket 44 is mounted on seat frame 40 near the rear of chair 10. One back bracket 44 is mounted to each side of frame 40, such that a left and right back bracket are used. In the embodiment shown in FIGS. 1-4, the bracket 44 is fixedly coupled to the frame 40. To achieve this coupling, a pair of mounting holes 46 is located in a middle section of the bracket 44. Holes 46 are both used in this embodiment to fix bracket 44 in place with respect to frame 40. The upper section of bracket 44 is fixedly coupled to the seat back 18. As best seen in FIG. 4, back 18 is shown without the usual padding material, upholstery or other covering for the sake of clarity. The lower section of bracket 44 extends below and beside the frame 40, and will be discussed in more detail with respect to FIGS. 5-7 below.

Returning now to the front of chair 10, a mounting tube 48 is coupled to the front section of 26 of bracket 24. The tube 48 can be attached to bracket 24 in any way that provides a long-lasting attachment. Tube 48 extends between brackets 24 and forms a mounting location for a u-shaped yoke 50 as best seen in FIG. 4. Yoke 50 is attached to tube 48 such as by weldment, bolts, screws or the like. Yoke 50 has a pair of spaced apart legs 52 with a mounting hole 54 through each leg 52. Mounting holes 54 are used to pivotally couple an actuator 56 to the yoke 50. Actuator 56 can be a motorized actuator, as shown, or could be another device that operates to linearly extend a rod 58 or other element from a main body. Gas cylinders and electric actuators are some of the devices suitable for use. The actuator 56 should be capable of moving seat 16 when a person is seated within chair 10. While not shown, it should be understood that actuator 56 has a corresponding control associated with the chair 10 such that a user of the chair can control the actuator 56. For example, the control could be physically mounted to the chair 10 in a convenient location, such as on the arm, or could be a control wand arrangement. The end of actuator 56 opposite tube 48 is also coupled to a u-shaped mounting yoke, labeled as 60, having a pair of mounting holes 62. Yoke 60 provides a pivotal coupling between actuator 56 and a mounting bridge 64. A pin or other element is placed through holes 62 and the extending rod from actuator 56 to achieve the pivotal coupling. Yoke 60 is fixedly attached to the mounting bridge 64. The mounting bridge 64 is, in turn, coupled to the seat frame 40, extending from one side to the other. As an example, bridge 64 can be welded to seat frame 40, although other rigid mounting arrangements could be used as well.

In use, the chair 10 can be used as a normal chair, as shown in FIG. 1. In this position, the chair functions as any other chair. The chair can be moved, by controlling the actuator, to the position shown in FIG. 2. In this position, the user of the chair is assisted in exiting the chair. To achieve this position, the user uses the control associated with the actuator 56. The actuator extends rod 58 to exert an upward force on seat 16. The pivot mounting of actuator 56 at yokes 50 and 60 allows the actuator to pivot as needed. The seat 16 is allowed to pivot upwardly due to its coupling to bracket 24 at hole 34. In this embodiment, the back is fixed relative to the seat, such that the back and seat orientation remain the same throughout the motion of the seat.

Figure 5:
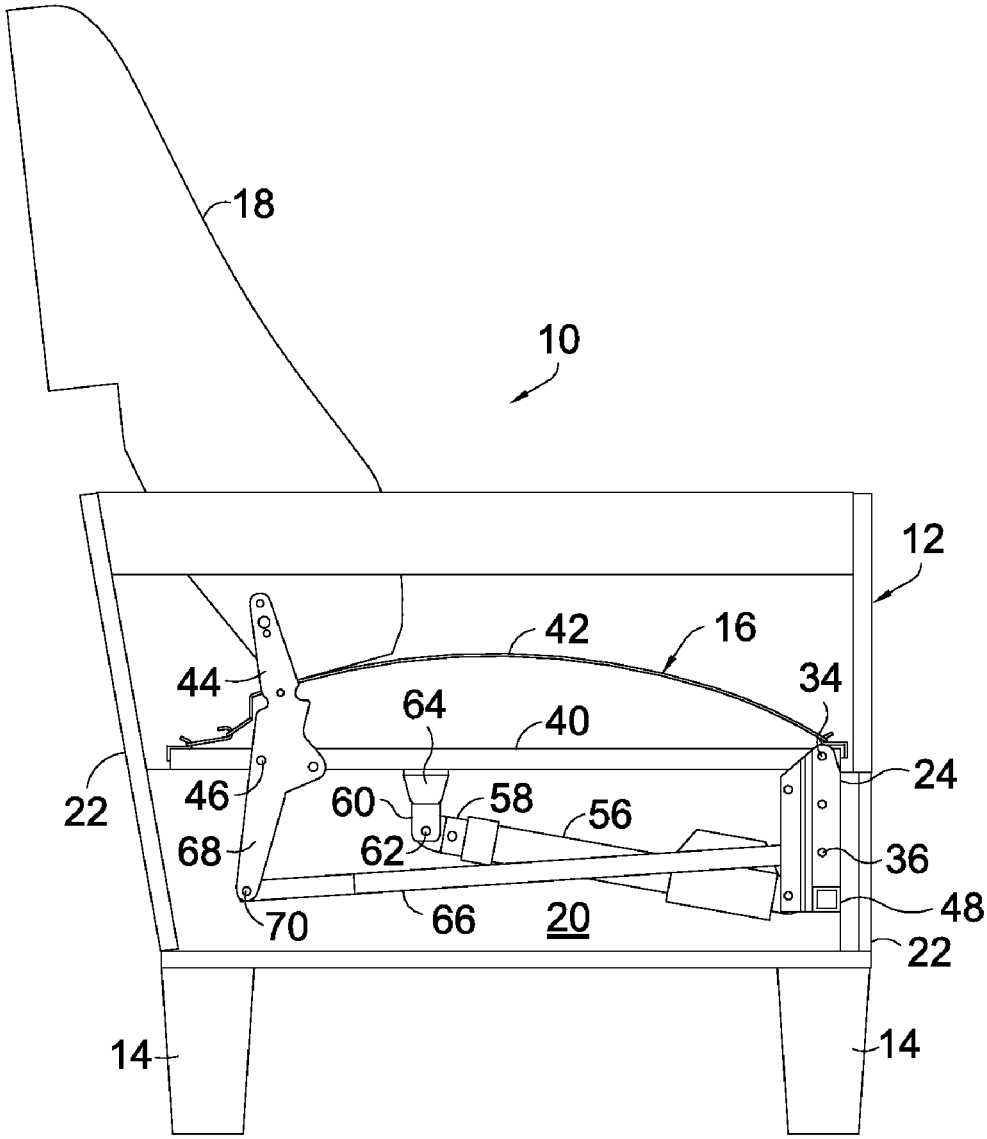
FIG. 5 is a side cross-sectional view of a different embodiment of an article of seating furniture with certain parts removed for clarity.
Figure 6:
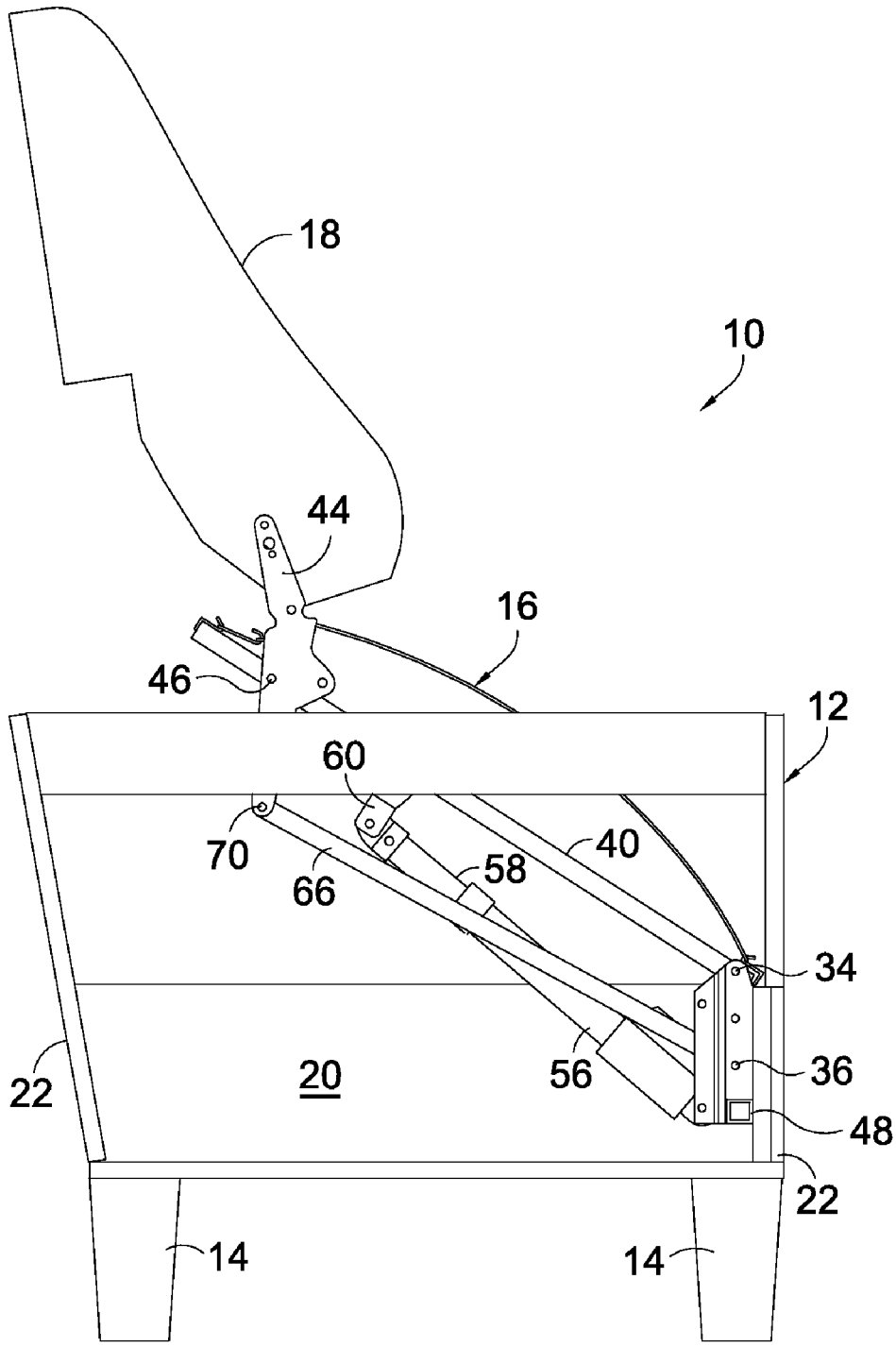
FIG. 6 is a view similar to FIG. 5, showing the seat in a raised position.
Figure 7:
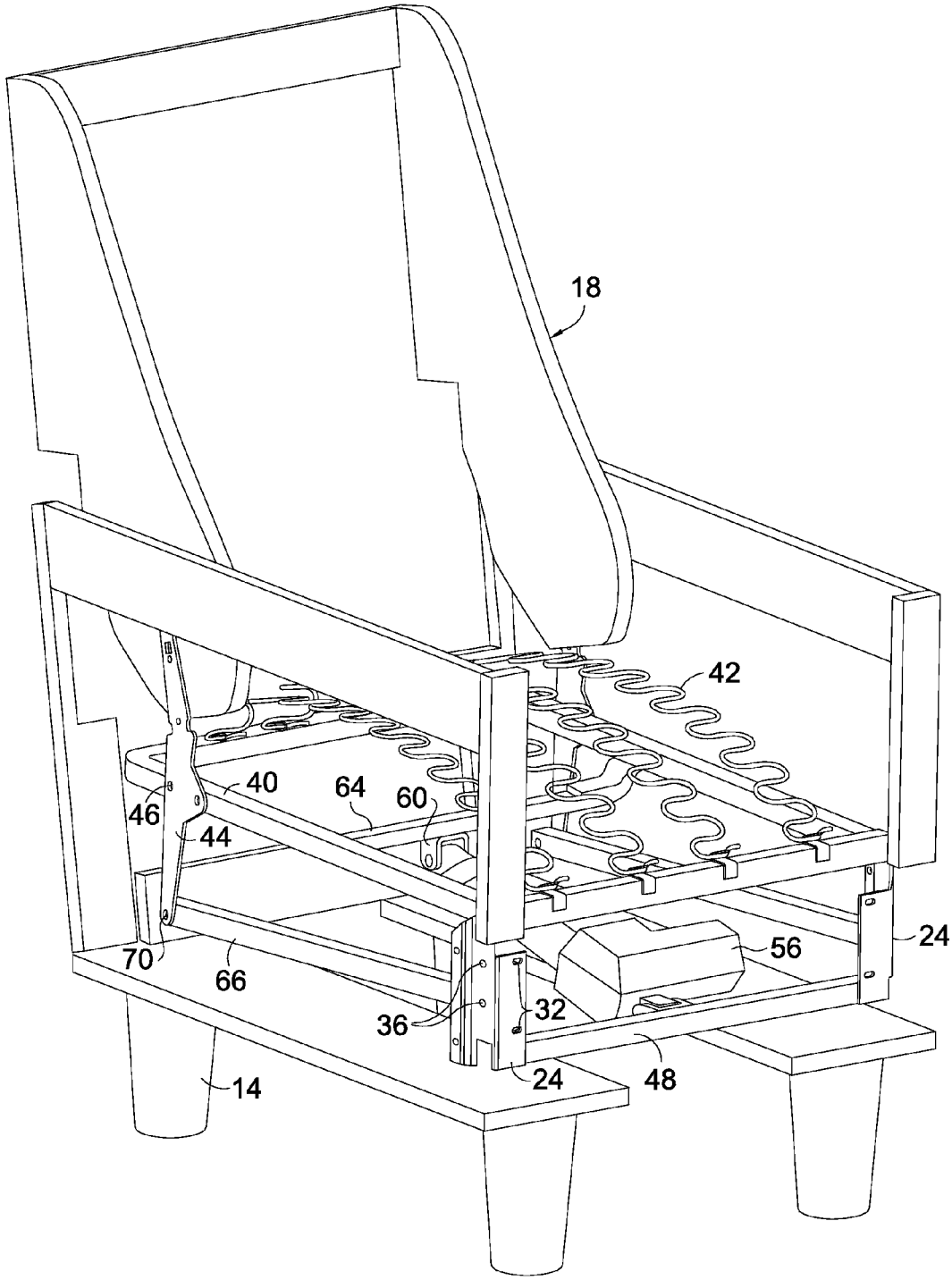
FIG. 7 is a perspective view of the embodiment of FIG. 5, again with parts removed for clarity.
Figure 8:
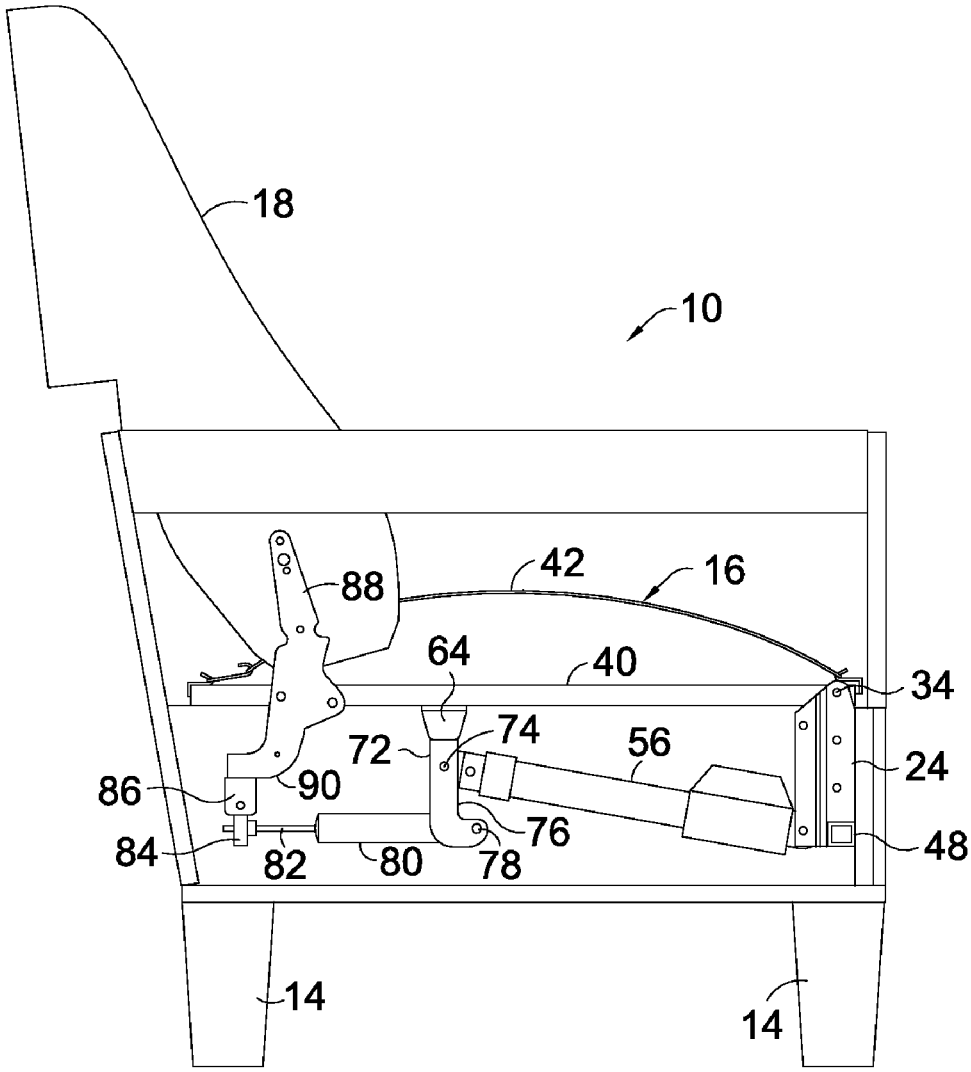
FIG. 8 is a side cross-sectional view of a different embodiment of an article of seating furniture with certain parts removed for clarity.

Another embodiment of chair 10 is shown in FIGS. 5-7. Many of the components are the same as that described above with respect to FIGS. 1-4, as evidenced by the same reference numerals. The embodiment shown in FIGS. 5-7 adds a linkage bar 66. Bar 66 is coupled proximate the front of chair 10. More specifically, bar 66 is pivotally coupled to bracket 24 using one of lower holes 36. The location at which bar 66 is coupled to bracket 24 determines the motion of back 18, as is further discussed below. A number of holes 36 are provided to allow the desired motion to be achieved. The opposite end of bar 66 is pivotally coupled to the lower end 68 of back bracket 44 using a hole 70 in the back bracket. As best seen in FIG. 7, it is preferable that a linkage bar 66 be provided on each side of chair 10.

The other change in the embodiment shown in FIGS. 5-7, compared with that of FIGS. 1-4, is that back bracket 44 is rotatably coupled to seat frame 40. To achieve this coupling, only one hole 46 is used. As shown in FIGS. 5-7, only the rear-most hole 46 is used.

The addition of bar 66 allows and forces the back 18 to recline, or pivot rearwardly, as the actuator rod 58 is extended. In use, the chair functions as a normal chair when the actuator is not extended, as shown in FIG. 5. In this position, a user would notice no difference between the chair of FIG. 1 and the chair of FIG. 5. If the user desires to exit the chair 10 and to have assistance, the user can use the control for the actuator 56 to extend the rod 58. As the rod 58 extends, the seat 16 is forced upwardly, pivoting about the attachment point at hole 34. As the seat frame pivots upwardly, bar 66 exerts a rotating force on back bracket 44 (counter-clockwise as viewed in FIG. 6). Back bracket 44 pivots about the attachment point at hole 46. Because the back 18 is fixedly coupled to back bracket 44, the back 18 is forced into a reclining motion, pivoting rearwardly away from seat 16. This allows the back 18 to move away from the occupant as the seat 16 rises. Certain users may find this more comfortable, as the back will allow the user to maintain a different posture when exiting the chair.

The addition of bar 66 is a simple operation, and can be done by a manufacturer prior to sale or even in a post-sale, retrofit environment. The coupling of back bracket 44 to seat frame 40 is changed from a fixed coupling to a rotatable coupling, and the bar 66 is pivotally coupled to back bracket 44 and lift frame bracket 24. In this way, the same basic components can be used to achieve two entirely different motions, based on the desire of the chair manufacturer and chair user.

Figure 9:
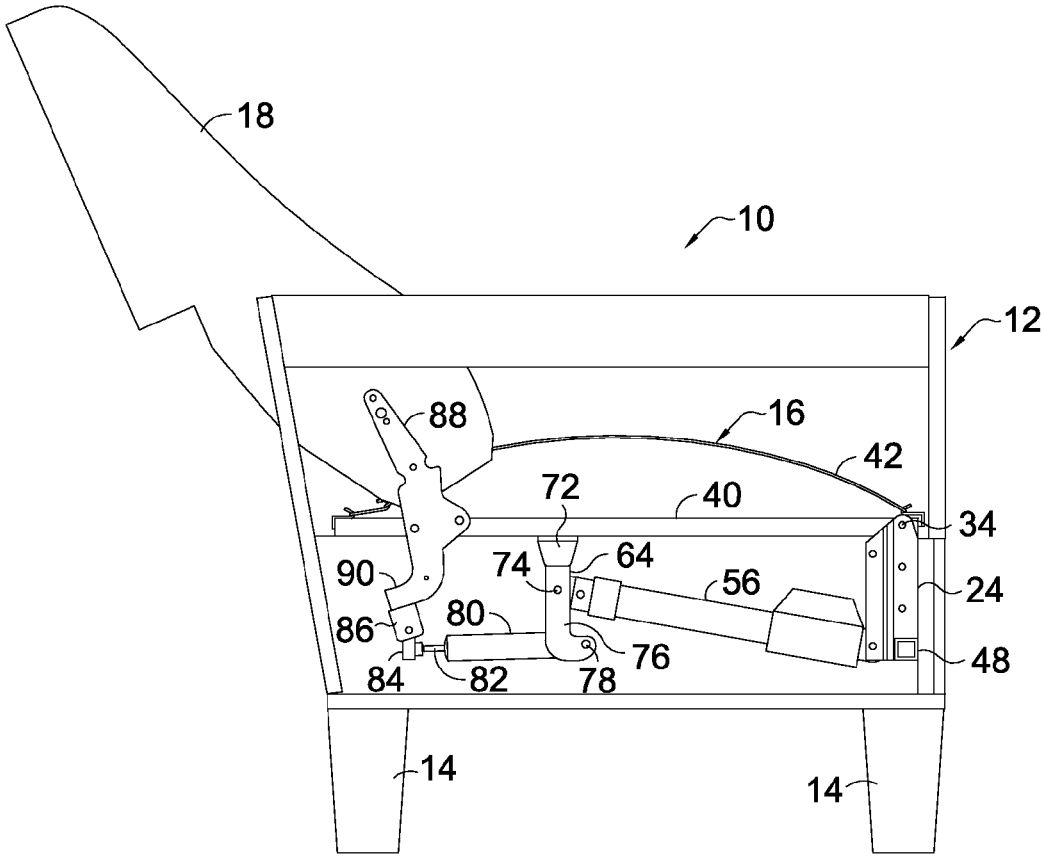
FIG. 9 is a view similar to FIG. 8, showing the back in a reclined position.
Figure 10:
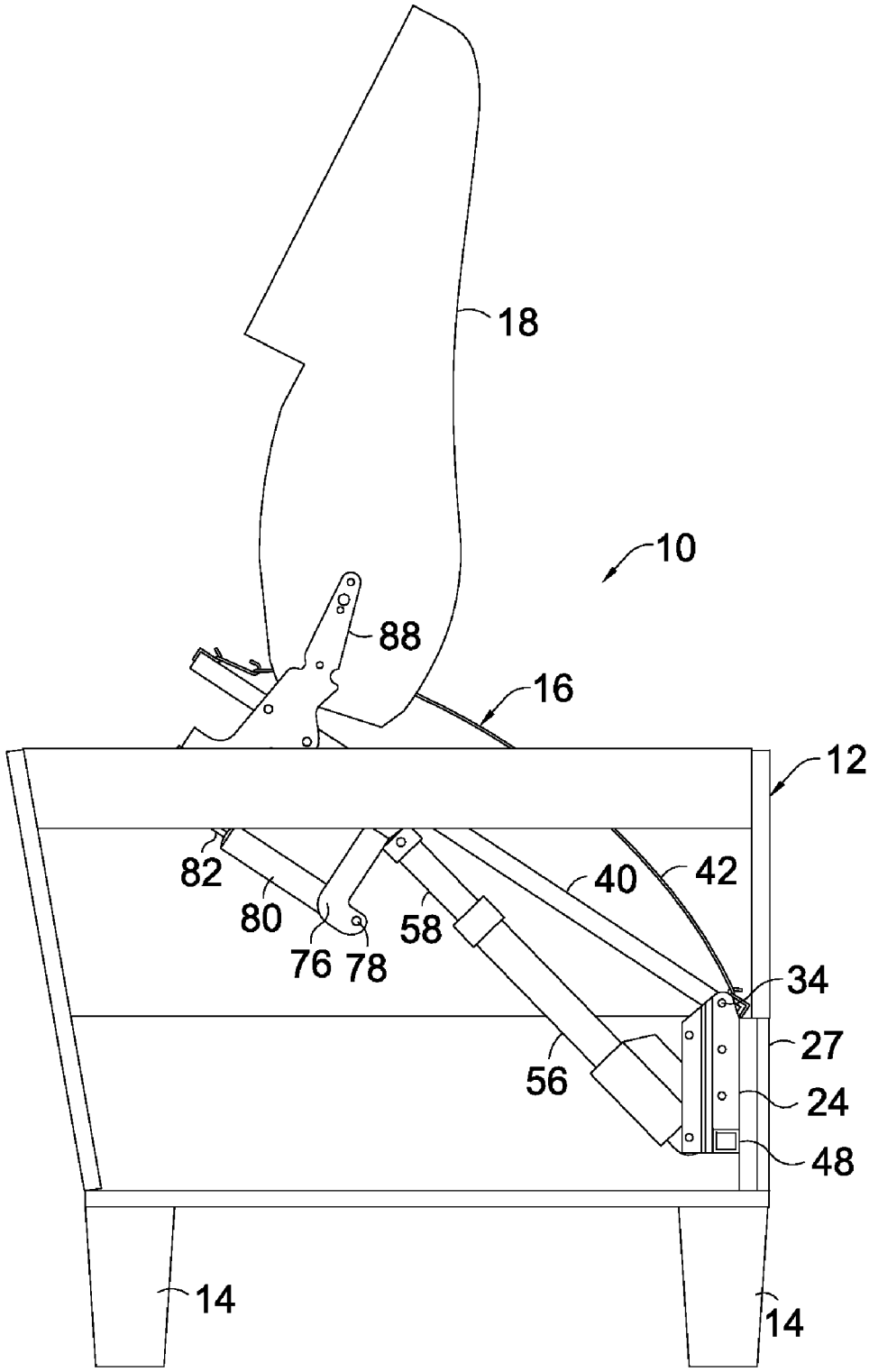
FIG. 10 is a view similar to FIG. 8, showing the seat in a raised position.
Figure 11:
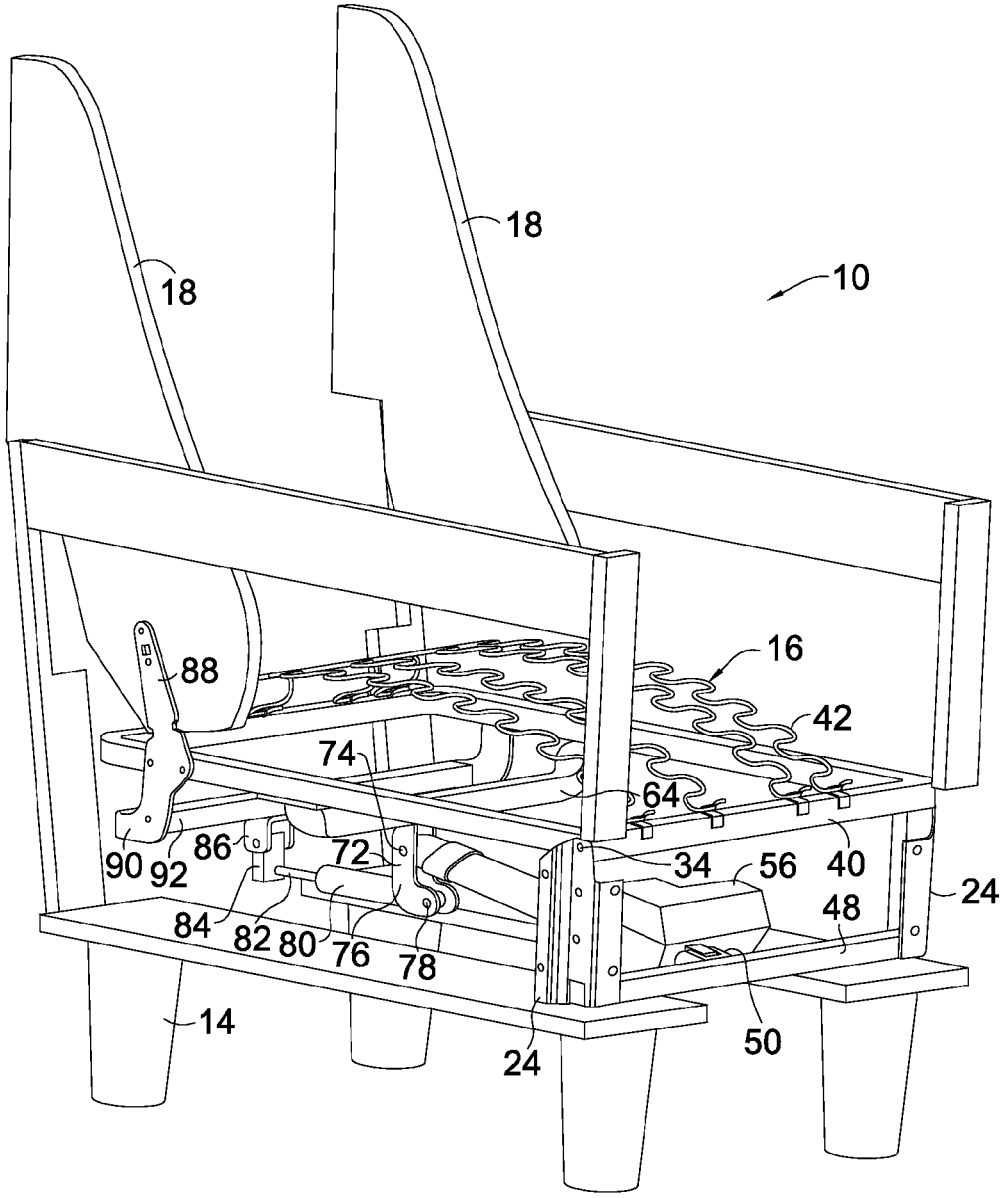
FIG. 11 is a perspective view of the embodiment of FIG. 8, again with parts removed for clarity.

Yet another embodiment of chair 10 is shown in FIGS. 8-11. In this embodiment, many of the same components are used, as evidenced by the use of the same reference numerals for the same components described above. In the embodiment of FIGS. 8-11, the connection between the actuator 56 and the back 18 is different. A different yoke 72 is attached to mounting bridge 64. Yoke 72 has holes 74 that are used to pivotally couple the yoke 72 to the actuator 56. However, yoke 72 also has a pair of depending legs 76. Legs 76 extend downwardly from bridge 64 and extend toward the front of chair 10. Each leg 76 has a hole 78 extending through it. A second actuator 80 is coupled between legs 76, using holes 78. Actuator 80 extends toward the rear of chair 10. Actuator 80 can be a gas cylinder or other device that operates to retract and extend a rod 82. While not shown, the actuator 80 also has a control associated therewith that allows the user to engage the actuator 80 when desired, as is more-fully described below. The rod 82 is attached to a coupling block 84, which is in turn pivotally coupled to a yoke 86. Yoke 86 is rigidly coupled between back brackets 88 as is more-fully described below. Bracket 88 differs from bracket 44 in the lower portion. Bracket 88 is fixedly coupled to back 18 and rotatably coupled to seat frame 40, as in the embodiment shown in FIGS. 5-7. Bracket 88 has a mounting leg 90 that extends inwardly from the side of chair 10. Leg 90 is used to rigidly couple bracket 88 to a cross tube 92. Cross tube 92 and legs 90 thus serve to connect the brackets 88. Cross tube 92 serves as the mounting base for the yoke 86, as best seen in FIG. 11.

In use, the chair 10 can function as a normal chair, just as the embodiments shown in FIGS. 1 and 5. In contrast to the chairs described above with respect to FIGS. 1-7, the chair of FIGS. 8-11 allows the user to recline the back 18 with the user in a seated position, as shown in FIG. 9. To recline the back, the user must engage the actuator 80. Actuator 80 functions to retract rod 82, which in turn exerts a forward motion on the lower end of bracket 88. The bracket 88 pivots about the connection point to seat frame 40, which in turn reclines the back 18.

The chair 10 of FIGS. 8-11 also allows the user to move the chair to the assist position shown in FIG. 10. To achieve this position, the user engages actuator 56, as with the embodiments of FIGS. 1-7. As shown in FIG. 10, the user can engage only actuator 56, in which case the back 18 of chair 10 will remain fixed relative to the seat 16. The user could also first engage actuator 80, in which case the back 18 will be reclined relative to seat 16 with the seat in the assisted position.

Yet another embodiment of chair 10 is shown in FIGS. 12-17. Many of the components are the same as that described above with respect to FIGS. 8-11, as evidenced by the same reference numerals. The embodiment shown in FIGS. 12-17 adds a linkage mechanism 100 to connect the base 12 to the seat 16, the importance of which will be discussed in greater detail below.

Figure 12:
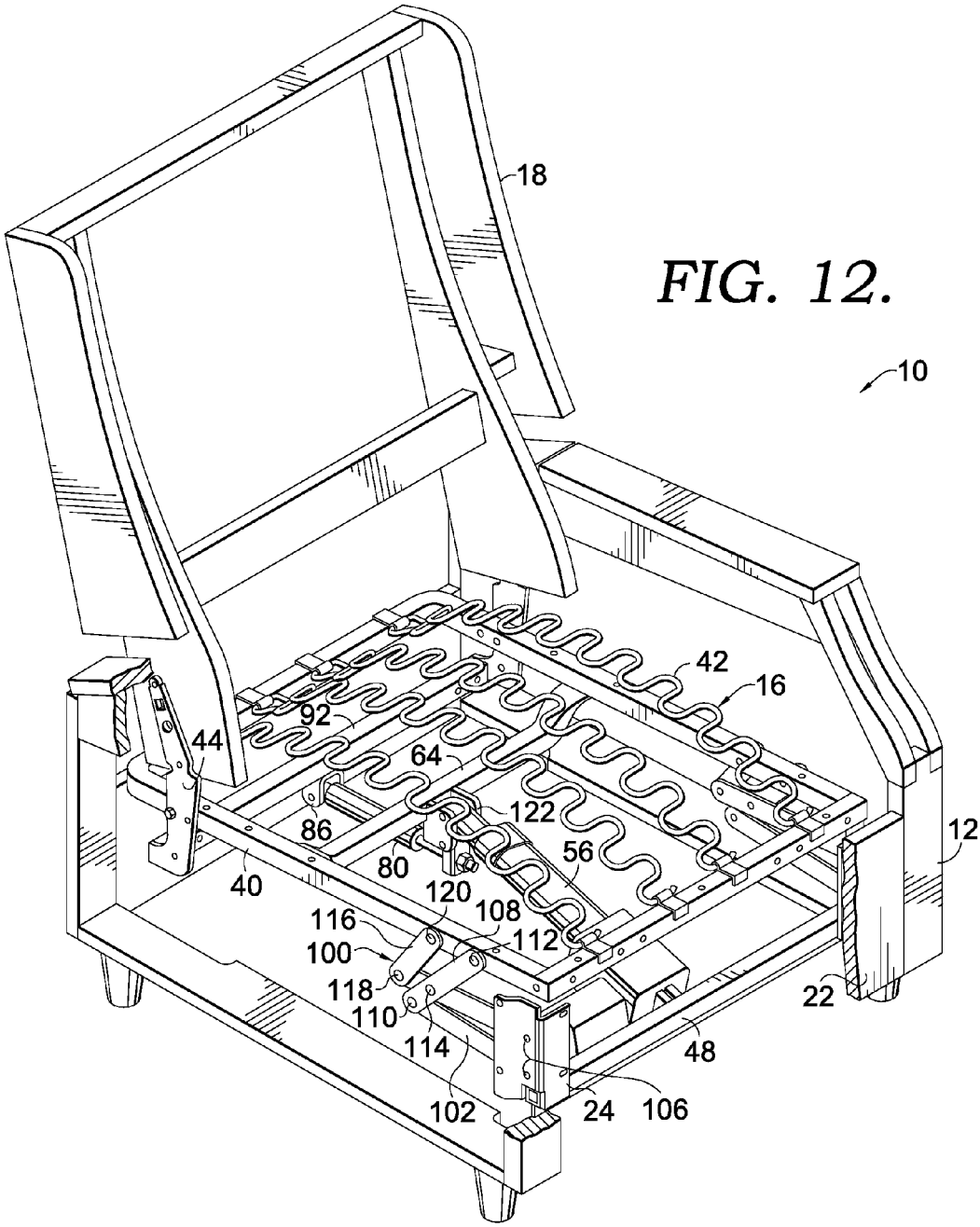
FIG. 12 is a perspective view of a different embodiment of an article of seating furniture with certain parts removed for clarity.
Figure 13:
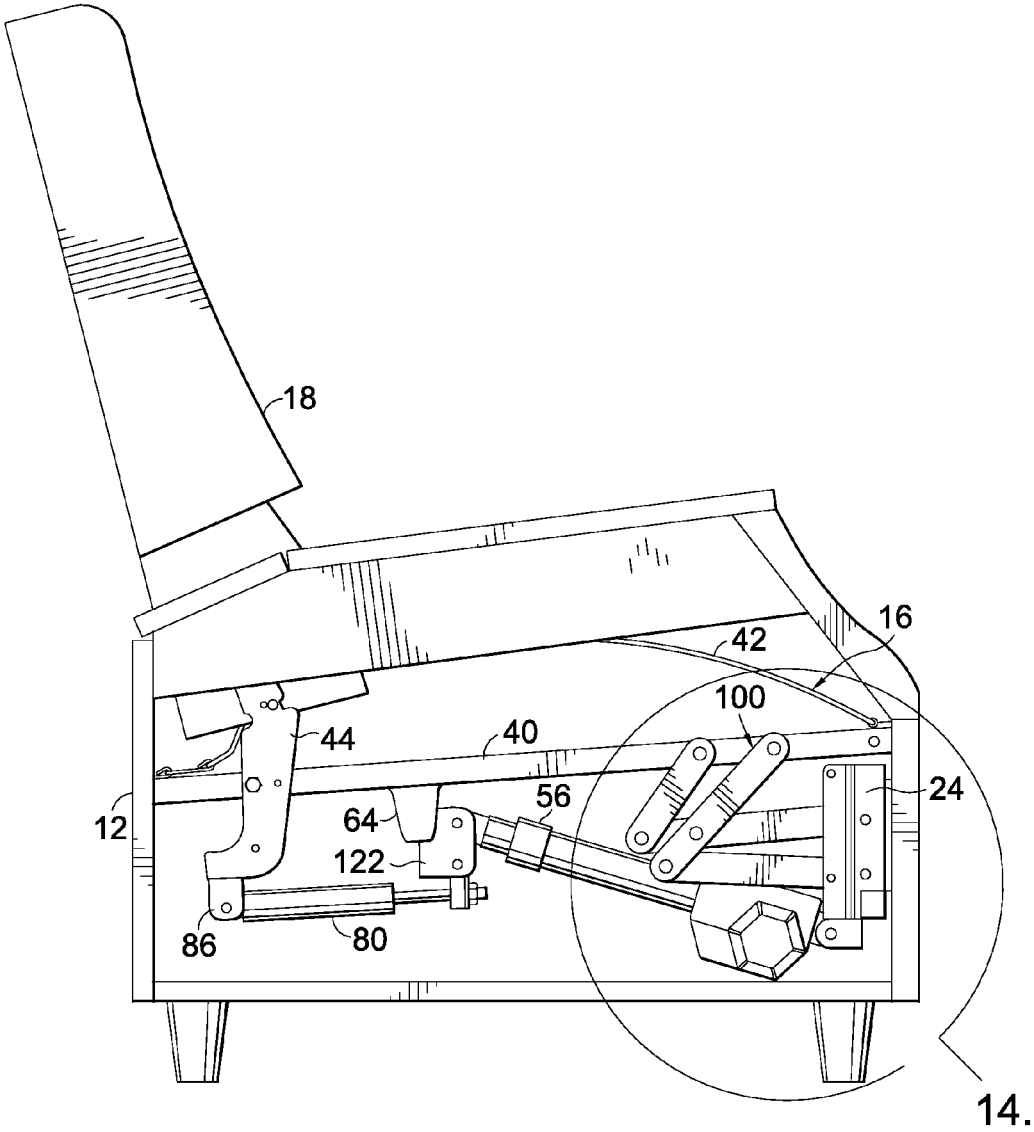
FIG. 13 is a side elevation view of the embodiment of FIG. 12.
Figure 14:
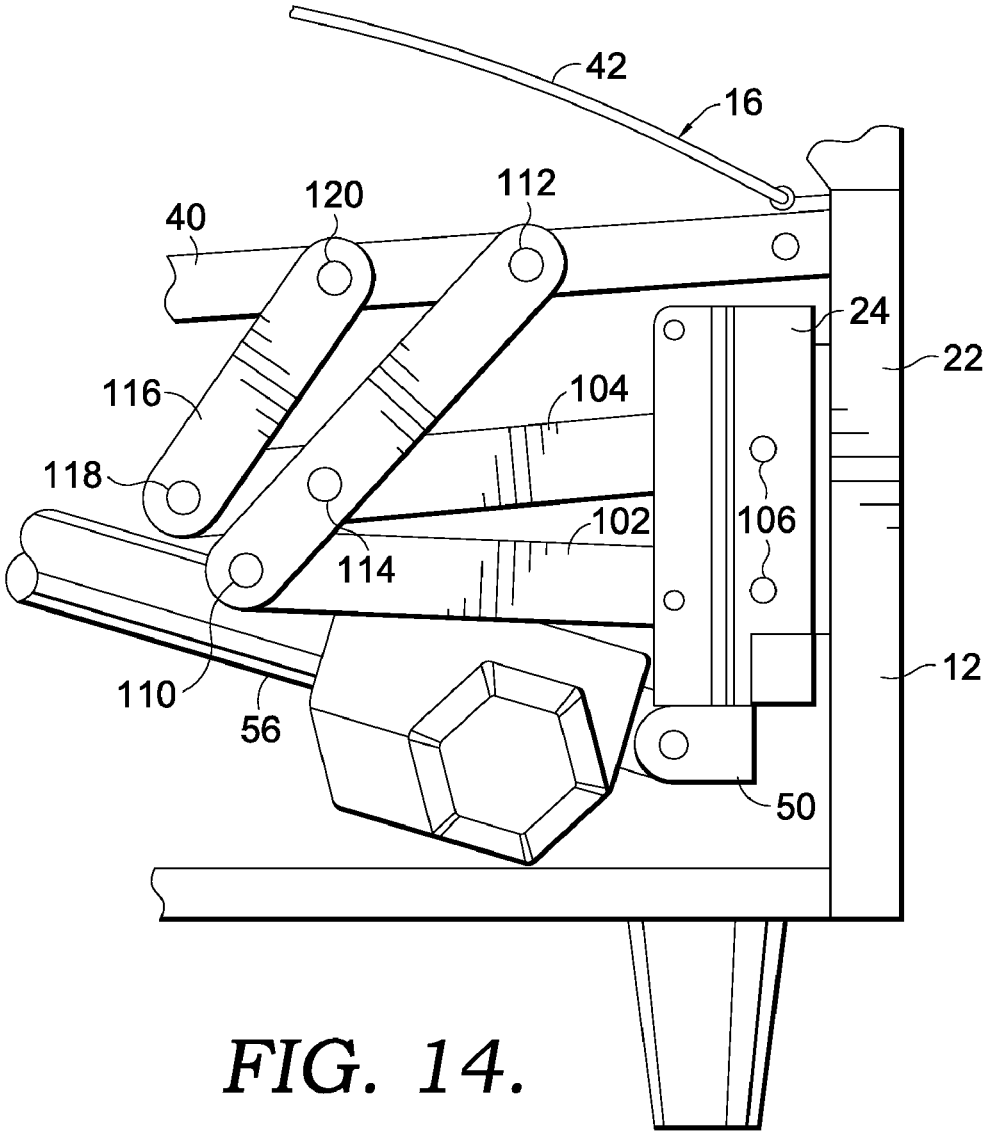
FIG. 14 is an enlarged view of the area indicated by circle 14 of FIG. 13.

Linkage 100 is coupled on one end to lift frame bracket 24. More specifically, linkage 100 includes a first link 102 and a second link 104, each having one end pivotally coupled to lift frame bracket 24. Bracket 24 is slightly different in this embodiment and includes a pair of mounting holes 106 that allow the pivotal coupling of links 102 and 104. As best seen in FIG. 14, a third link 108 is pivotally connected to link 102 on the end opposite bracket 24 as indicated by number 110. Link 108 is also pivotally coupled on the opposite end to seat frame 40 at pivot point 112. A third pivotal connection exists between the two ends of link 108 to the second link 104 as indicated at pivot point 114. Linkage 100 also has a fourth link 116 that is pivotally connected on one end to second link 104, as indicated by pivot point 118, and on the other end to seat frame 40, as indicated by pivot point 120. As further described below, linkage 100 serves as the connection between the base 12 and the seat frame 40. Seat frame 40 is not pivotally connected to bracket 24 at its front end, as noted with respect to the embodiment of FIGS. 1-11. As best seen in FIG. 12, each side of chair 10 has a linkage 100 coupling the base 12 to the seat 16.

Figure 15:
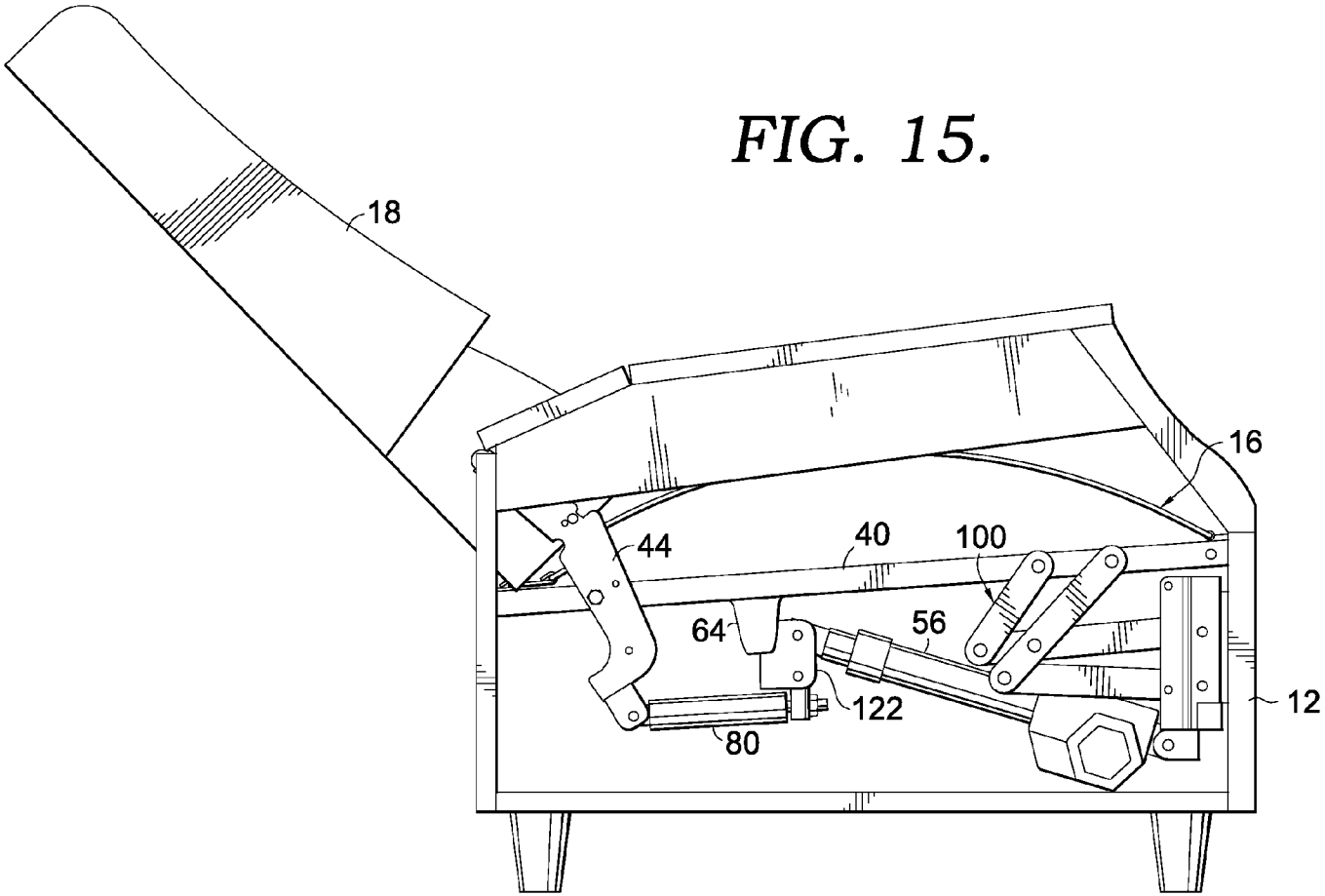
FIG. 15 is a view similar to FIG. 13, showing the back in a reclined position.

The embodiment of FIGS. 12-17 is shown with a slightly different yoke 122 pivotally connecting the actuator 56 to the bridge 64. Yoke 122 also serves to pivotally connect the yoke 122 to the second actuator 80. As with the embodiment shown in FIGS. 8-11, actuator 80 is pivotally connected on its opposite end to a yoke 86, which is in turn coupled to the cross tube 92. As best seen in FIG. 15, the embodiment of FIGS. 12-17 allows the back of the chair to recline. The position of the back is held in place through actuator 80. While not shown, it should be understood by those of skill in the art that actuator 80 is provided with a control mechanism that, when engaged, controls the actuator 80 to move the back of the chair.

Figure 16:
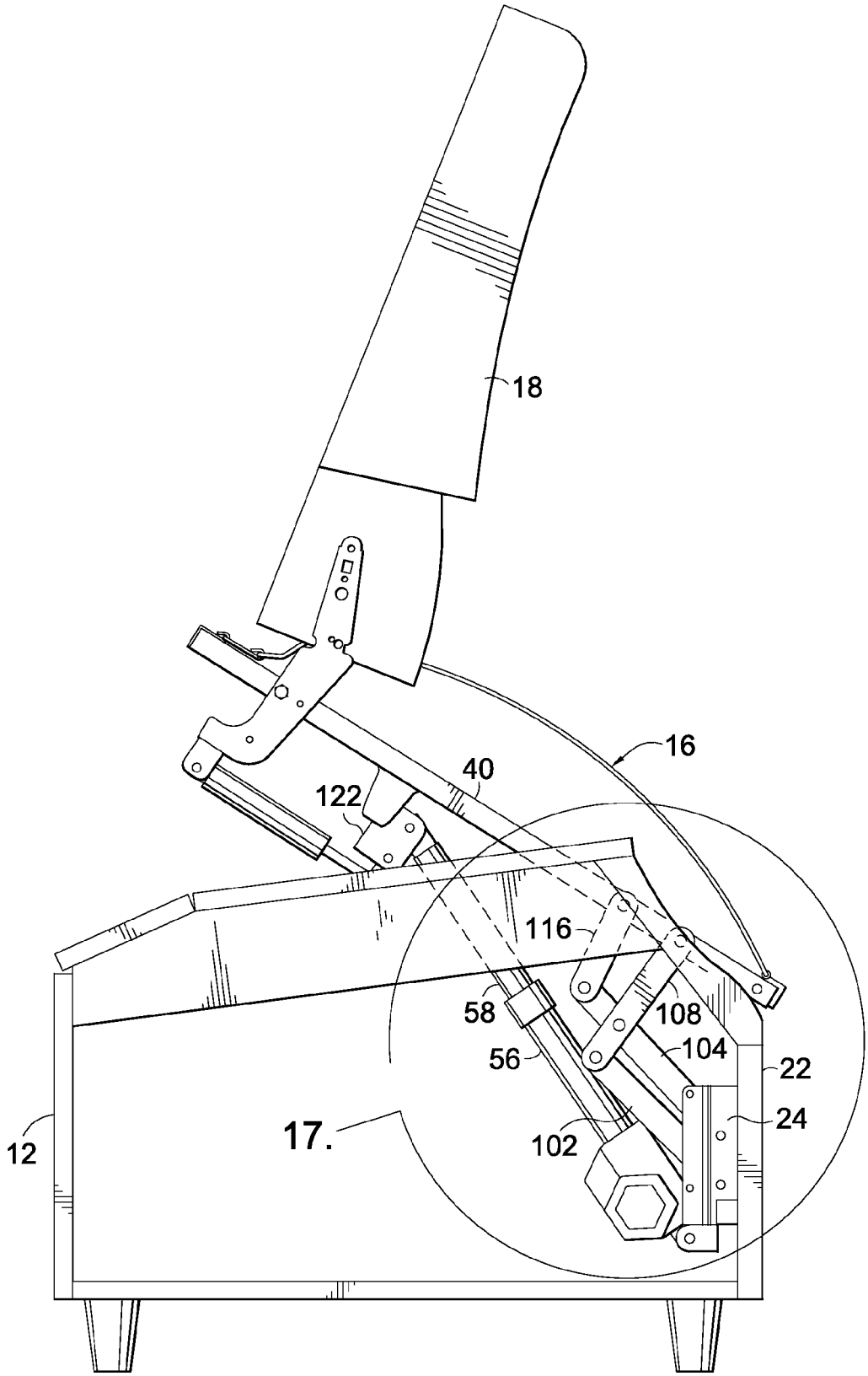
FIG. 16 is a view similar to FIG. 13, showing the seat and back in an elevated position.
Figure 17:
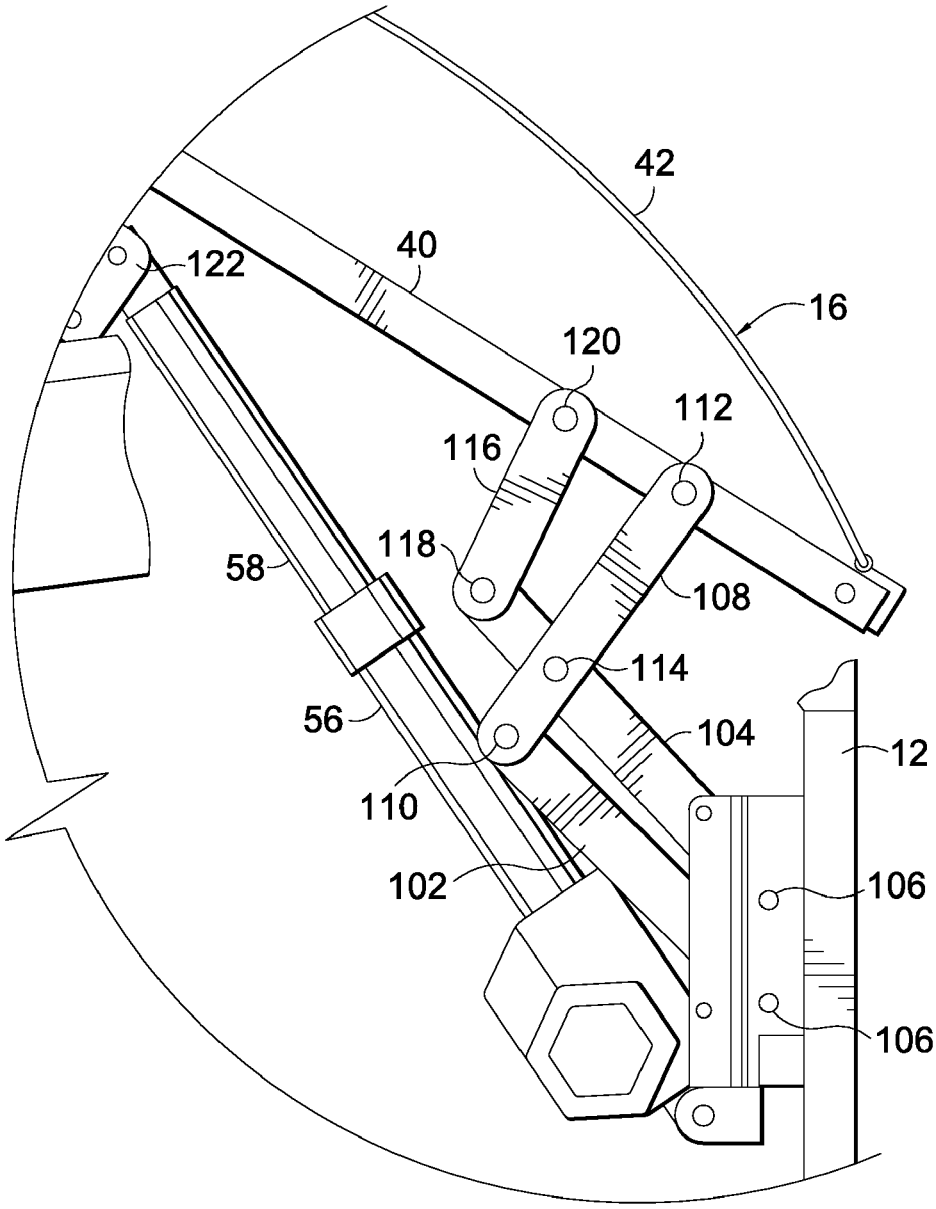
FIG. 17 is an enlarged view of the area indicated by circle 17 of FIG. 16.

In use, the actuator 56 can be used to lift the seat 16 and back 18, as best seen in FIGS. 16 and 17. Linkage 100 operates to lift and rotate the seat frame 40 as the rod 58 of actuator 56 extends. In contrast with the embodiments described with reference to FIGS. 1-11, linkage 100 not only rotates the seat frame 40, but also lifts the seat frame 40, including the front end. This arrangement provides more of a vertical lift assist to the chair occupant as compared to the embodiments of FIGS. 1-11.

Figure 18:
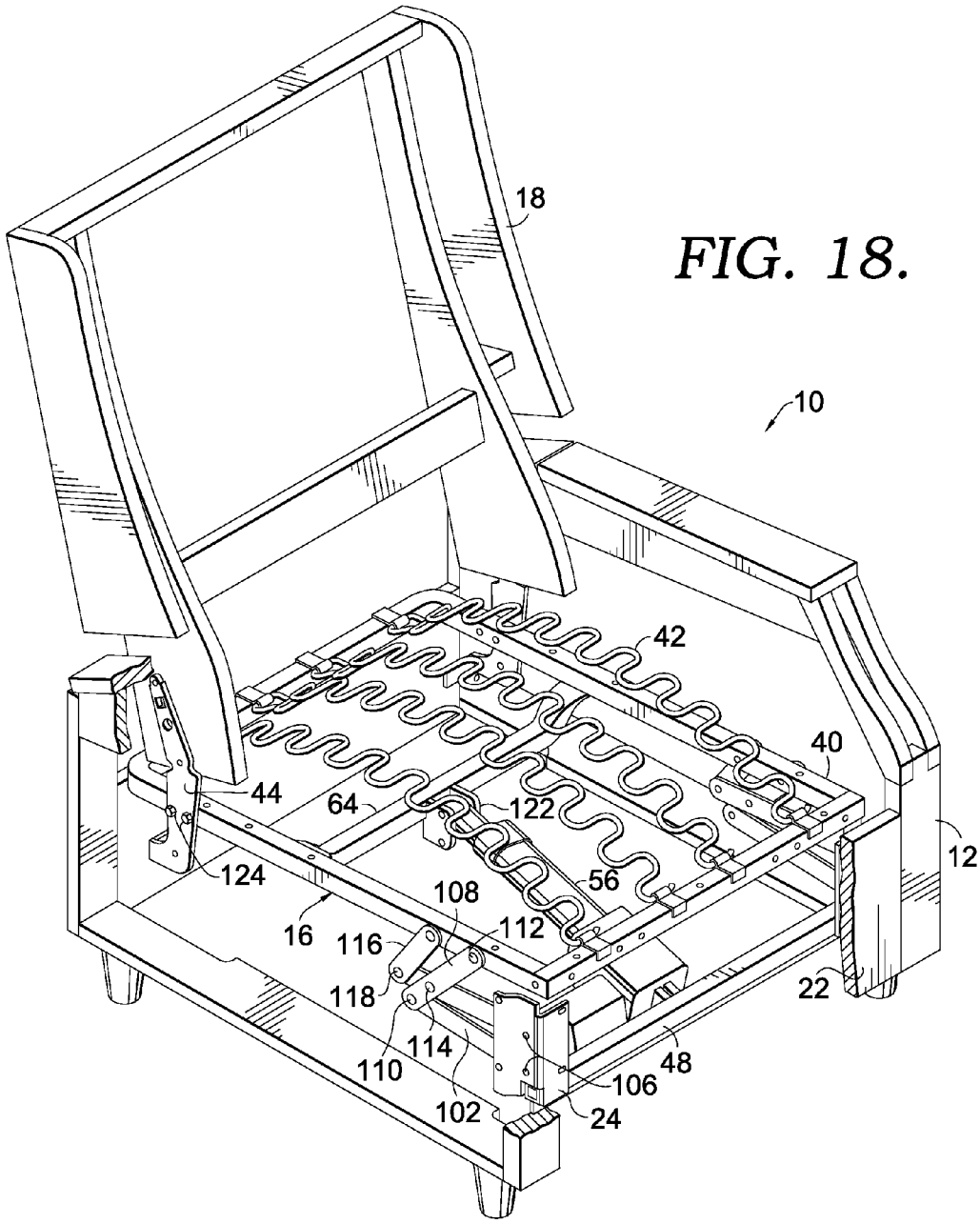
FIG. 18 is a perspective view of a different embodiment of an article of seating furniture with certain parts removed for clarity.
Figure 19:
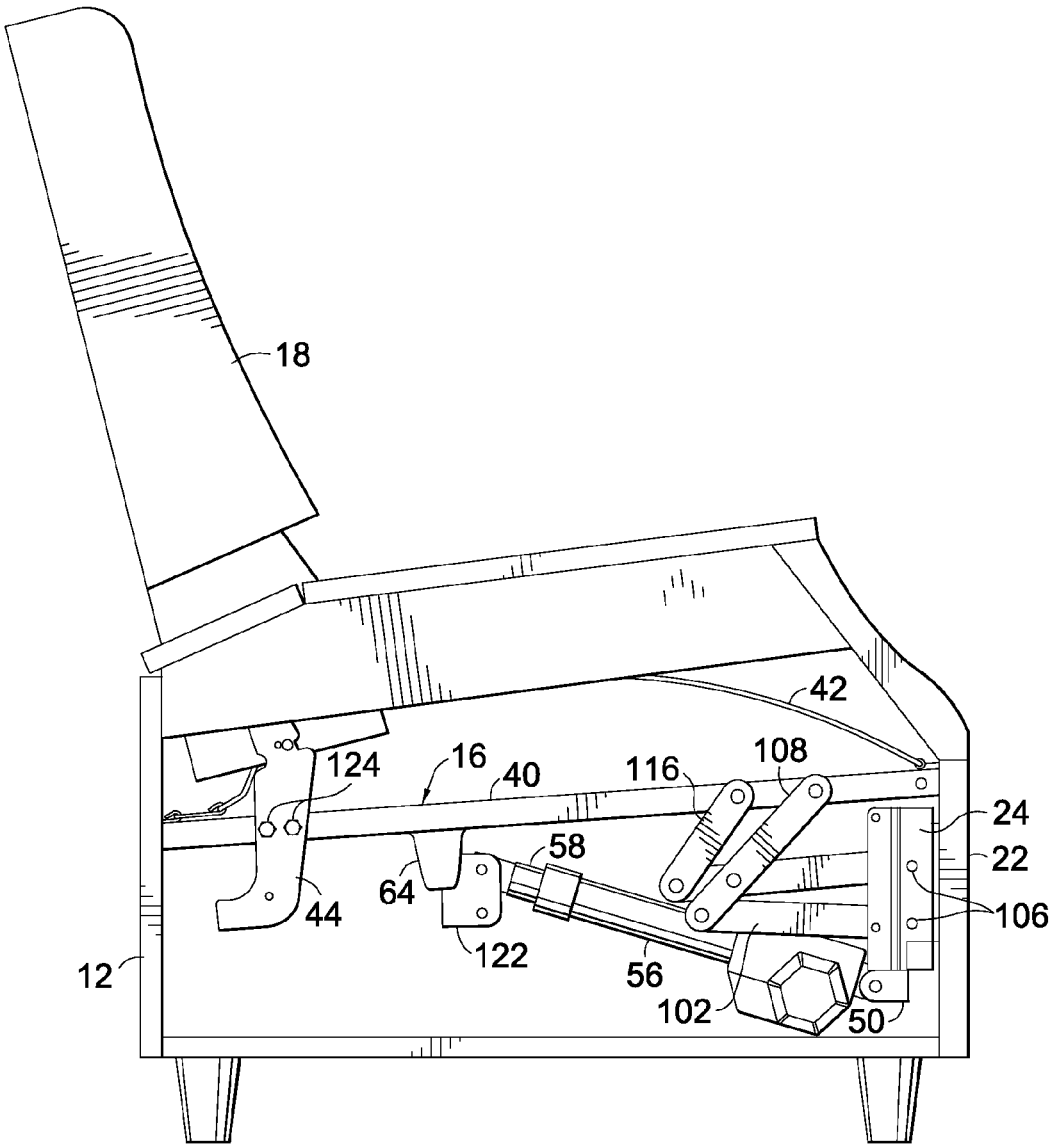
FIG. 19 is a side elevation view of the embodiment of FIG. 18.
Figure 20:
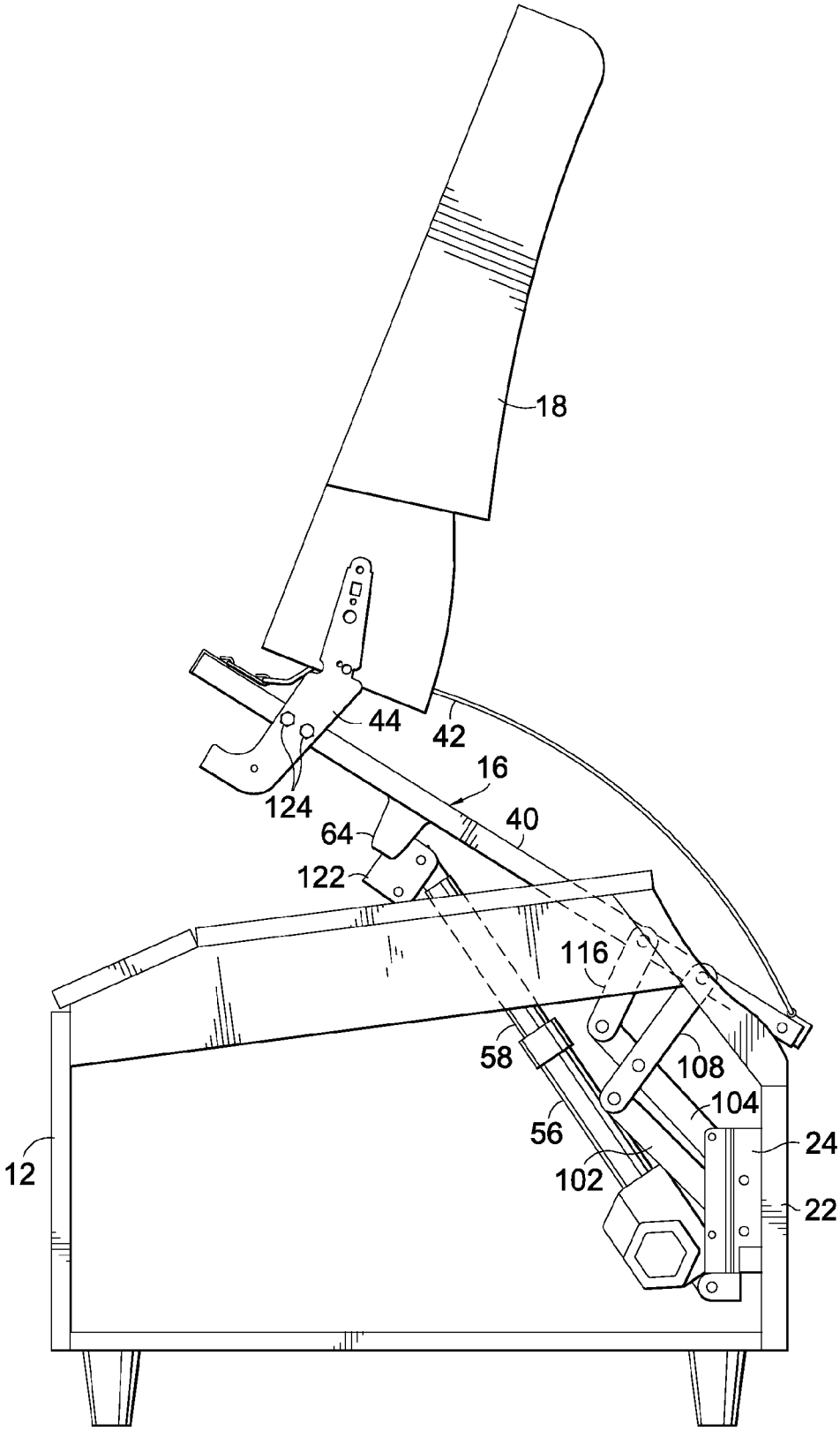
FIG. 20 is a view similar to FIG. 19, but showing the seat and back in an elevated position.

Yet another embodiment of chair 10 is shown in FIGS. 18-20. Many of the components are the same as that described above with respect to FIGS. 12-17, as evidenced by the same reference numerals. The embodiment shown in FIGS. 18-20 is simplified as compared to that of FIGS. 12-17. In the embodiment of FIGS. 18-20, the second actuator 80 and cross tube 92 are removed. Additionally, the back brackets 88 are coupled to the frame 40 and are not allowed to rotate. As best seen in FIG. 19, back brackets 88 can be secured with two bolts 124 extending through mounting holes 46. Linkage 100 operates in this embodiment as described above with respect to FIGS. 12-17, as can best be seen by comparing FIGS. 16 and 20.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and sub-combinations are of utility and may be employed without reference to other features and sub-combinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An article of seating furniture, comprising:

a base having a front panel, wherein said base has spaced apart sides;

a seat having a front portion and a rear portion;

a linkage coupled between a front portion of the base and the seat;

a back coupled to said seat;

a mounting yoke mounted to said seat, wherein said mounting yoke has a downwardly depending pair of arms;

a first biasing member positioned between the mounting yoke and the base, the first biasing member being rotatably coupled to the base proximate the front panel of the base, and being rotatably coupled to the mounting yoke, wherein said first biasing member is centrally positioned between said spaced apart sides;

a lift frame bracket fixedly coupled to said front panel of said base, said lift frame bracket serving as the pivotal mount for said first biasing member proximate the front panel of said base;

a back bracket having a first end, a second end and a middle portion, said first end coupled to said back, and said middle portion coupled to said seat, wherein the first biasing member may be actuated to raise the seat from a seating position to an assisted position, with the seat motion controlled by the linkage, thereby allowing a user seated in the article of seating furniture to more easily exit the article of seating furniture;

a second biasing member mounted between said arms of the mounting yoke, wherein said second biasing member has a rod rotatably coupled to the second end of the back bracket; and wherein the second biasing member can be actuated to move the rod, thereby exerting a forward motion on the second end of the back bracket, causing the back bracket to rotate about its connection to the seat and exerting a reclining motion on said back.

2. The article of seating furniture of claim 1, wherein the linkage is a four bar linkage.

* * * * *